US009494889B2

(12) United States Patent
Tsuchiya et al.

(10) Patent No.: US 9,494,889 B2
(45) Date of Patent: Nov. 15, 2016

(54) IMAGE FORMING APPARATUS AND DETECTION APPARATUS

(71) Applicant: CANON KABUSHIKI KAISHA, Tokyo (JP)

(72) Inventors: Toshikazu Tsuchiya, Susono (JP); Takuya Mukaibara, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/442,009

(22) PCT Filed: Oct. 31, 2013

(86) PCT No.: PCT/JP2013/080169

§ 371 (c)(1),
(2) Date: May 11, 2015

(87) PCT Pub. No.: WO2014/097763

PCT Pub. Date: Jun. 26, 2014

(65) Prior Publication Data

US 2015/0301470 A1 Oct. 22, 2015

(30) Foreign Application Priority Data

Dec. 19, 2012 (JP) ..... 2012-277444

(51) Int. Cl.
*G03G 15/00* (2006.01)
*G03G 15/043* (2006.01)

(52) U.S. Cl.
CPC ..... *G03G 15/043* (2013.01); *G03G 15/5058* (2013.01)

(58) Field of Classification Search
CPC ..... G03G 15/043; G03G 15/5058
(Continued)

(56) References Cited

U.S. PATENT DOCUMENTS 8,260,164 B2 9/2012 Masuda
8,331,813 B2 12/2012 Ozeki
(Continued)

FOREIGN PATENT DOCUMENTS

JP 03-209281 A 9/1991
JP 9-247452 A 9/1997
(Continued)

OTHER PUBLICATIONS

International Search Report and Written Opinion in PCT/JP2013/080169 dated Dec. 3, 2013.

*Primary Examiner* — Susan Lee
(74) *Attorney, Agent, or Firm* — Fitzpatrick, Cella, Harper & Scinto

(57) ABSTRACT

An image forming apparatus includes an irradiation unit for irradiating an image carrier having a formed detection image with light, the irradiation unit being capable of switching a size of a light-emitting region; a light-receiving unit for receiving reflected light of the light irradiated by the irradiation unit and outputting a detection signal corresponding to a light-receiving amount of the reflected light including a specular-reflected light component; a detection unit for detecting one of position information and density information of the detection image based on the detection signal; and a control unit for controlling to switch the size of the light-emitting region to detect one of the position information and the density information of the detection image.

14 Claims, 15 Drawing Sheets

(58) Field of Classification Search
USPC ..... 399/49; 347/131
See application file for complete search history.

(56) References Cited

U.S. PATENT DOCUMENTS

| | | | | |
|---|---|---|---|---|
| 8,564,782 | B2 | 10/2013 | Masuda | |
| 8,787,782 | B2 | 7/2014 | Masuda | |
| 2005/0207768 | A1* | 9/2005 | Suzuki | G03G 15/5062 399/49 |
| 2009/0067859 | A1* | 3/2009 | Omelchenko | G03G 15/5058 399/49 |
| 2009/0220263 | A1* | 9/2009 | Murayama | G03G 15/5058 399/49 |
| 2011/0026956 | A1* | 2/2011 | Taguchi | G03G 15/5058 399/49 |
| 2014/0226997 | A1 | 8/2014 | Koyama et al. | |
| 2014/0308049 | A1 | 10/2014 | Yamaguchi et al. | |
| 2015/0037057 | A1 | 2/2015 | Masuda | |

FOREIGN PATENT DOCUMENTS

| | | | |
|---|---|---|---|
| JP | 2003-076129 | A | 3/2003 |
| JP | 2004-212577 | A | 7/2004 |
| JP | 2004-361871 | A | 12/2004 |
| JP | 2005-241933 | A | 9/2005 |
| JP | 2005-300918 | A | 10/2005 |
| JP | 2006-350383 | A | 12/2006 |
| JP | 2009-258601 | A | 11/2009 |
| JP | 2010-180570 | A | 8/2010 |
| JP | 2010-250049 | A | 11/2010 |
| JP | 2011-175080 | A | 9/2011 |
| JP | 2011-242441 | A | 12/2011 |
| JP | 2012-037258 | A | 2/2012 |
| JP | 2012-103567 | A | 5/2012 |
| JP | 2012-181414 | A | 9/2012 |
| JP | 2013-033181 | A | 2/2013 |
| JP | 2013-068971 | A | 4/2013 |
| JP | 2013-109319 | A | 6/2013 |

* cited by examiner

IMAGE FORMING APPARATUS AND DETECTION APPARATUS

TECHNICAL FIELD

The present invention relates to a color misalignment and density detection technique in an image forming apparatus such as a color laser printer, a color copying machine, and a color facsimile apparatus mainly using an electrophotographic process.

BACKGROUND ART

The mainstream of recent electrophotographic image forming apparatuses is a tandem type having a photosensitive member for each color to speed up printing. In the tandem-type image forming apparatus, for example, a detection image that is a developing material image used to detect a color misalignment or density is formed on an intermediate transfer belt. The color misalignment or density is corrected by detecting reflected light from the detection image using an optical sensor.

Japanese Patent Laid-Open No. 1991-209281 discloses providing two optical sensors that respectively detect specular-reflected light (to also be referred to as mirror-reflected light) and scatter-reflected light from a toner image and controlling the image density in accordance with the output difference between the two optical sensors. Japanese Patent Laid-Open No. 2003-76129 discloses an optical sensor that detects both specular-reflected light and scatter-reflected light using a prism. In these methods, one light-receiving element detects only the scatter-reflected light components, and correction is performed by, for example, subtracting the scatter-reflected light from the sum of the scatter-reflected light and specular-reflected light detected by the other light-receiving element, thereby extracting only the specular-reflected light components. In a method of detecting the density from the extracted specular-reflected light components, not the scatter-reflected light from the toner but the specular-reflected light from the background is mainly detected. Hence, the density can be detected independently of the color of the developing material that generates a difference in the scatter-reflected light amount. It is also supposedly possible to attain a high detection capability for a highlight region that is sensitive to the human visual characteristic. In the method of Japanese Patent Laid-Open No. 1991-209281, however, the error in correction processing of extracting only the specular-reflected light components becomes large. Japanese Patent Laid-Open No. 2005-300918 discloses reducing the effective spot diameter of specular-reflected light to lower the ratio of scatter-reflected light and thus improving the accuracy.

Consumption of the developing material by the detection image for color misalignment or density detection is required to be as low as possible. That is, the detection image is preferably made as small as possible. Even for a small detection image, a sensor having a high spatial resolution is necessary to accurately detect the density. Japanese Patent Laid-Open No. 2005-241933 discloses a sensor having a smaller irradiation area on the light emission side.

When the spot diameter of specular-reflected light is reduced in the conventional optical sensor, a variation of the LED chip position in the optical sensor or a mechanical variation of the converging mechanism greatly affects the yield in the manufacture or the detection accuracy. For example, to raise the spatial resolution of the optical sensor, the converging mechanism needs to be small. However, according to Japanese Patent Laid-Open No. 2005-241933, the spot diameter of the specular-reflected light is limited to about 1 mm when the variation in the manufacture and the like are taken into consideration. In addition, noise generated by the fine uneven pattern of the intermediate transfer belt surface becomes large as the spatial resolution of the optical sensor rises. As a result, the S/N ratio lowers, particularly affecting the density detection accuracy.

SUMMARY OF INVENTION

According to an aspect of the present invention, an image forming apparatus includes: an image carrier; forming means for forming a detection image made of a developing material on the image carrier; irradiation means for irradiating the image carrier having the formed detection image with light, the irradiation means being capable of switching a size of a light-emitting region to emit the light to irradiate; light-receiving means for receiving reflected light of the light irradiated by the irradiation means and outputting a detection signal corresponding to a light-receiving amount of the reflected light including a specular-reflected light component; detection means for detecting one of position information and density information of the detection image based on a signal corresponding to a difference between a value of the detection signal corresponding to the light-receiving amount of the reflected light from a first position where the detection image is formed and the value of the detection signal corresponding to the light-receiving amount of the reflected light from a second position different from the first position during a time when the detection image formed on the image carrier passes through an irradiation region of the irradiation means; and control means for controlling to switch the size of the light-emitting region of the irradiation means to detect one of the position information and the density information of the detection image.

Further features of the present invention will become apparent from the following description of exemplary embodiments with reference to the attached drawings.

DESCRIPTION OF EMBODIMENTS

Figure 1A:
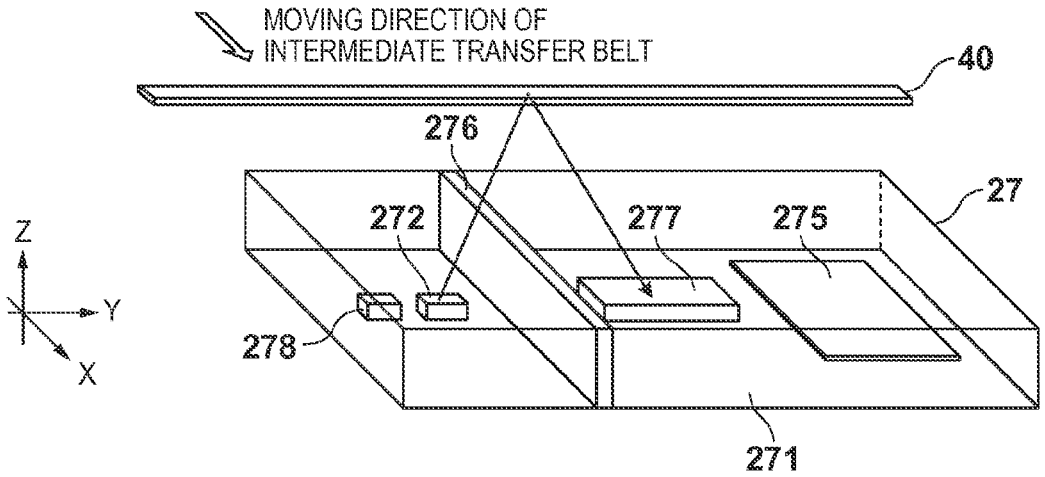
FIGS. 1A to 1C are views showing an optical sensor and a detection image including one line according to an embodiment.

Exemplary embodiments of the present invention will now be described with reference to the accompanying drawings. Note that the constituent elements unnecessary for the description of the embodiments are not illustrated in the following drawings. The same reference numerals denote the same or similar constituent elements throughout the drawings.

First Embodiment

Figure 16:
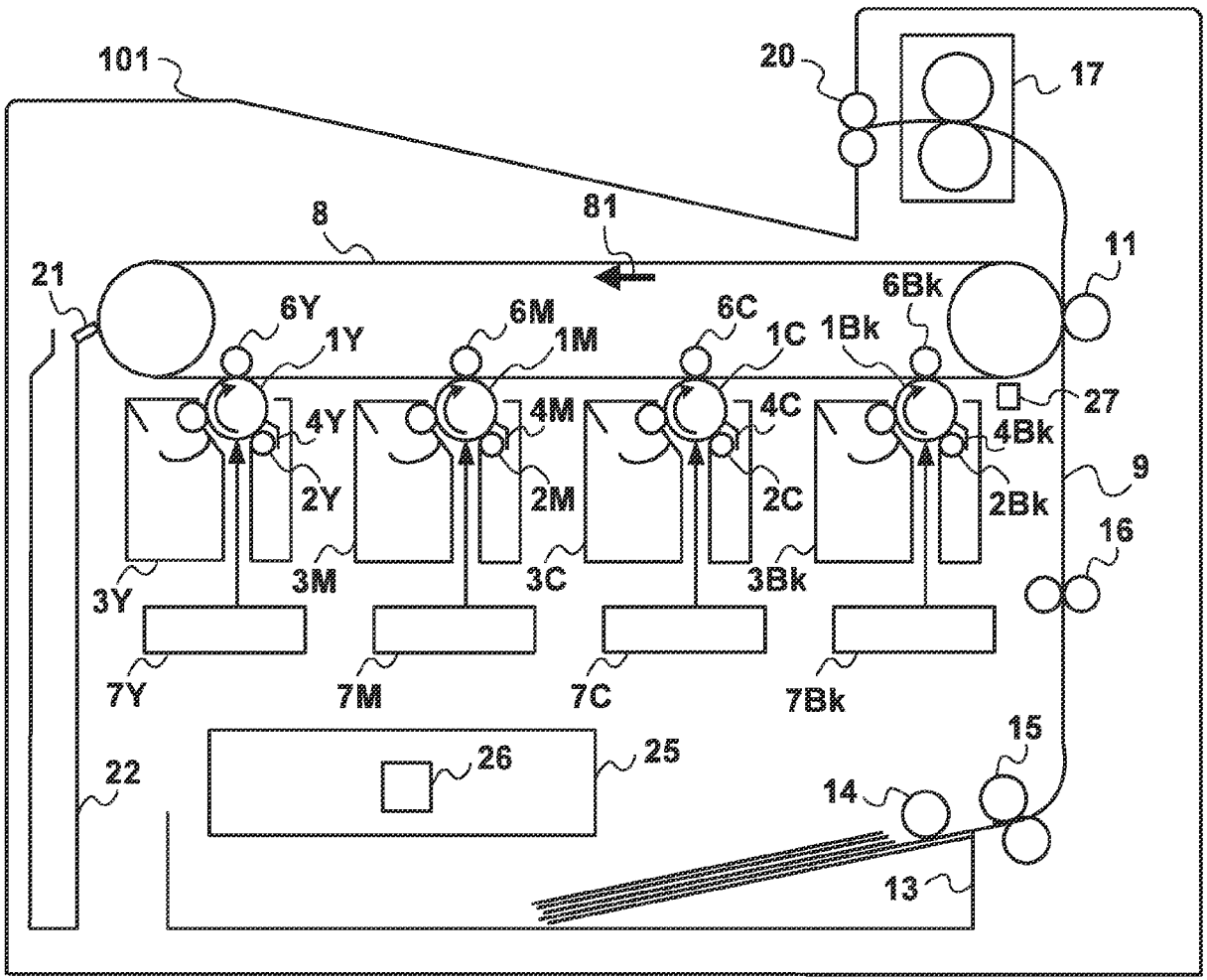
FIG. 16 is a view showing the schematic arrangement of an image forming apparatus according to an embodiment.

An image forming apparatus 101 according to this embodiment will be described first with reference to FIG. 16. Note that the suffixes Y, M, C, and Bk of the reference numerals in FIG. 16 indicate that toners serving as developing materials for the corresponding members are yellow, magenta, cyan, and black, respectively. Note that reference numerals without the suffixes Y, M, C, and Bk are used when the colors need not be distinguished in the following description. A charging unit 2 uniformly charges a photosensitive member 1 serving as an image carrier rotated in the direction of an arrow in FIG. 16. An exposure unit 7 irradiates the photosensitive member 1 with a laser beam to form an electrostatic latent image on it. A developing unit 3 supplies a developing material to the electrostatic latent image by applying a developing bias and changes the electrostatic latent image to a toner image (developing material image) that is a visible image. A primary transfer roller 6 transfers the toner image on the photosensitive member 1 to an intermediate transfer belt 8 by a primary transfer bias. Note that the intermediate transfer belt 8 is rotated in the direction of an arrow 81. The photosensitive members 1 transfer the toner images to the intermediate transfer belt 8 in a superimposed manner, thereby forming a color image. A cleaning blade 4 removes the toner remaining on the photosensitive member 1 without being transferred to the intermediate transfer belt 8.

Conveyance rollers 14, 15, and 16 convey a printing medium in a cassette 13 to the position of a secondary transfer roller 11 along a conveyance path 9. The secondary transfer roller 11 transfers the toner image on the intermediate transfer belt 8 to the printing medium by a secondary transfer bias. Note that the toner remaining on the intermediate transfer belt 8 without being transferred to the printing medium is removed by a cleaning blade 21 and collected by a waste toner collection container 22. A fixing unit 17 heats and pressurizes the printing medium with the transferred toner image to fix the toner image. The printing medium is then discharged by conveyance rollers 20 out of the apparatus. Note that an engine control unit 25 includes a microcontroller 26 and performs sequence control of various kinds of driving sources (not shown) of the image forming apparatus or various kinds of control using sensors. An optical sensor 27 is provided at a position facing the intermediate transfer belt 8.

For example, in a tandem-type image forming apparatus, the mechanical dimensions deviate from the design values due to assembly errors, parts tolerance, thermal expansion of parts, and the like upon manufacturing the apparatus, resulting in displacement for each color. Hence, a detection image used to detect the color misalignment of each color is formed on the intermediate transfer belt 8 or the like, and reflected light from the formed detection image is detected by the optical sensor 27. The print start positions in the main scanning direction and sub-scanning direction and the image clock are adjusted for each color based on the detection result, thereby correcting the color misalignment. Additionally, in the image forming apparatus, the tint, density, and the like of the output image may change due to temporal changes or continuous printing. To correct this variation, density control is performed. In the density control, the detection image used to detect the density of each color is formed on the intermediate transfer belt 8 or the like, and reflected light from the formed detection image is detected by the optical sensor 27. The detection result is fed back to each voltage condition or a process formation condition such as laser power, thereby correcting the maximum density or halftone characteristic of each color. Density detection by the optical sensor 27 is generally done using a method of irradiating the detection image with a light source and detecting the intensity of reflected light by a light-receiving element. A signal corresponding to the intensity of the reflected light is processed by the microcontroller 26 and fed back to the process formation conditions. Maximum density control aims at maintaining predetermined color balance between colors and preventing spattering or a fixing failure of a color-overlaid image caused by excessive toner application. On the other hand, halftone control aims at preventing natural image formation from failing due to the shift of the output density with respect to the input image signal caused by a nonlinear input/output characteristic.

Details of the optical sensor 27 according to this embodiment will be described below with reference to FIGS. 1A to 1C and 2A to 2C. FIGS. 1A and 2A are perspective views of the optical sensor 27 and a detection image 40 formed on the intermediate transfer belt 8 and including one line perpendicular to the moving direction of the intermediate transfer belt 8. Note that although the one line will be explained as a solid line in the following embodiment, it may be a discontinuous line such as a dotted line or a broken line. For the sake of illustrative simplicity, the intermediate transfer belt 8 is not illustrated in FIGS. 1A and 2A. The optical sensor 27 according to this embodiment includes light-emitting elements 272 and 278, a light-receiving element 277, a processing circuit 275, and a light blocking wall 276 arranged on a package board 271. A normal light-emitting element used to detect color misalignment and density incorporates a reflecting plate to collect light diffused like a flare from the light-emitting element. A shell-shaped light-emitting element includes a condenser lens as well. On the other hand, the optical sensor 27 according to this embodiment includes neither a reflecting plate nor a condenser lens but only an LED chip, thereby irradiating the intermediate transfer belt with divergent light beams of a point source. The element on the light-receiving side similarly uses no condenser lens but, for example, a photodiode that outputs a current corresponding to a light-receiving amount. That is, reflected light from the intermediate transfer belt 8 is converted by the light-receiving element into a current corresponding to the light-receiving amount without passing through an optical member configured to converge or condense the light. The light-emitting elements 272 and 278 are on/off-controlled by the microcontroller 26. The processing circuit 275 processes the signal detected by the light-receiving element 277, and outputs the processed signal to the microcontroller 26 as a photodetection signal. Note that the optical sensor 27 is packaged by a resin and glass. The light blocking wall 276 is provided to prevent light emitted by the light-emitting elements 272 and 278 from entering the light-receiving element 277 directly as stray light or after being reflected by the interface of the package.

In this embodiment, the light-emitting element 272 or 278 emits light, and color misalignment and density are detected based on reflected light received by the light-receiving element 277 during the time the detection image 40 is passing through the region of the intermediate transfer belt 8 irradiated with the light. Basically, the color misalignment amount is detected by detecting the pass timing of the detection image 40 of each color. The density is detected by sensing the average light amount from the detection image 40 formed in halftone. The color misalignment and density are detected based on the specular-reflected light components. When the light-emitting element emits infrared light, the black toner mostly absorbs the light, and the toners of the remaining colors scatter-reflect the irradiation light. On the other hand, when the light-emitting element emits red light, the black and cyan toners mostly absorb the light, and the toners of the remaining colors scatter-reflect the irradiation light.

That is, it is necessary to perform processing of removing the scattered light components by the detection image 40 from the mixed state of the toners that scatter-reflect the irradiation light and the toners that mostly absorb the light but poorly reflect. To do this, the conventional optical sensor 27 includes a converging mechanism, and a light-receiving element configured to sense only the scatter-reflected light components is separately provided. However, the optical sensor 27 of this embodiment includes no converging mechanism, and removes the scatter-reflected light components using the light-receiving element 277 that receives both specular-reflected light and scatter-reflected light. The optical sensor 27 of this embodiment includes no converging mechanism formed from optical members and can therefore be downsized to a fraction of the conventional size. In addition, since the scatter-reflected light components are removed using the light-receiving element 277, the correction accuracy at the time of removal can be raised. Furthermore, since no converging mechanism exists, the optical sensor 27, that is, the light-emitting elements and the light-receiving element can be made small without posing a problem by variations in the manufacture. When the light-receiving element becomes small, the spot diameter of specular reflection also becomes small, and the resolution can be increased.

In this embodiment, the two light-emitting elements 272 and 278 whose light-emitting regions have different sizes are used. However, three or more light-emitting elements may be used. The following description will be made assuming that the light-emitting region of the light-emitting element 272 is smaller than that of the light-emitting element 278.

Figure 1B:
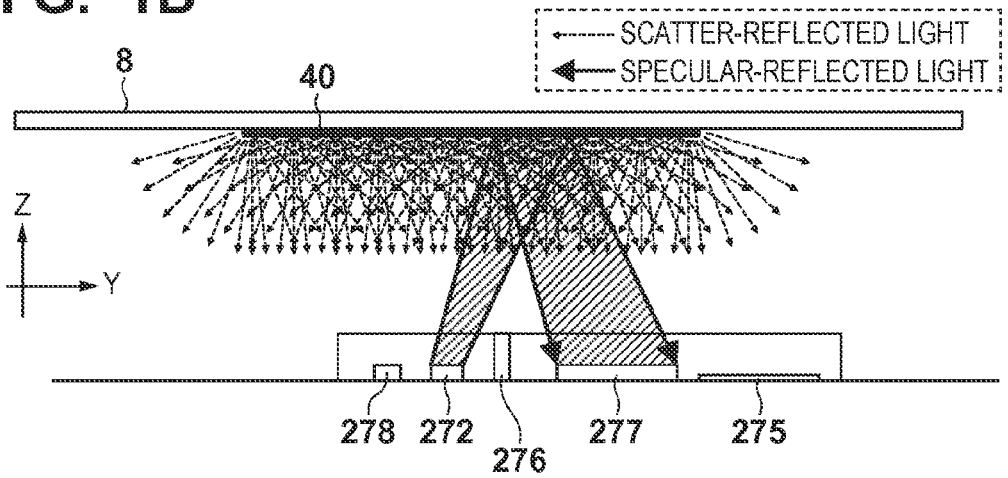
Figure 1C:
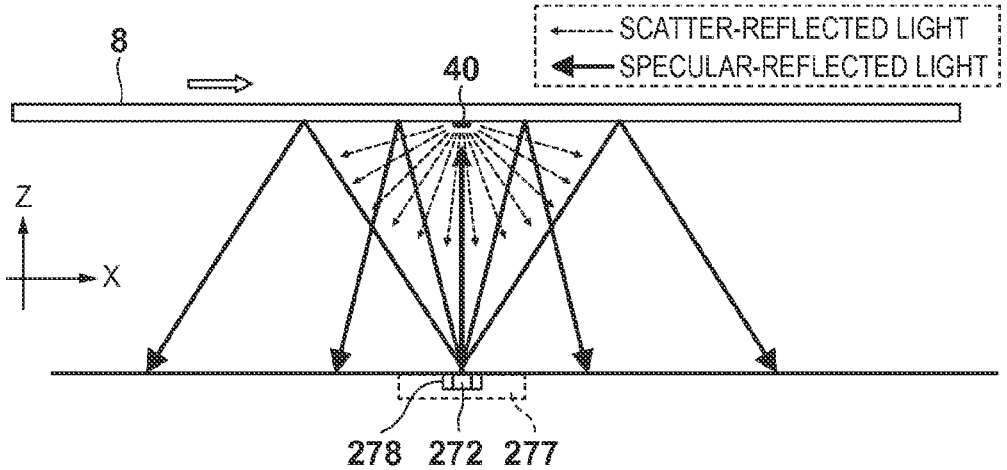
Figure 2A:
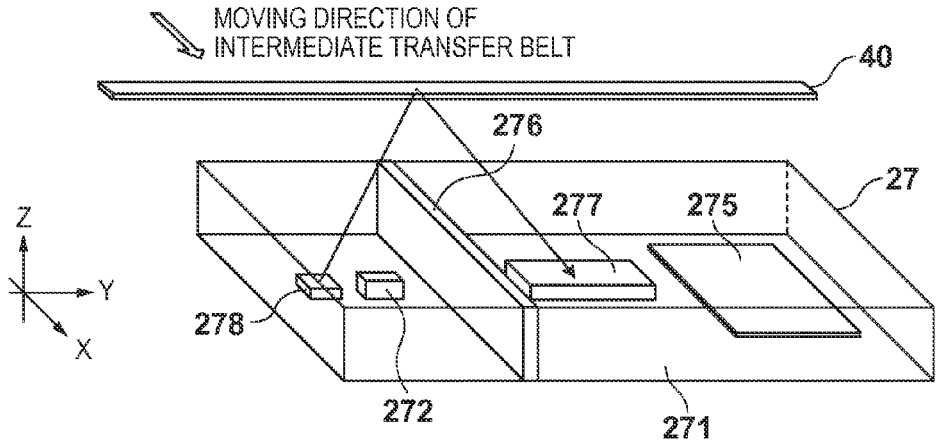
FIGS. 2A to 2C are views showing the optical sensor and the detection image including one line according to an embodiment.
Figure 2B:
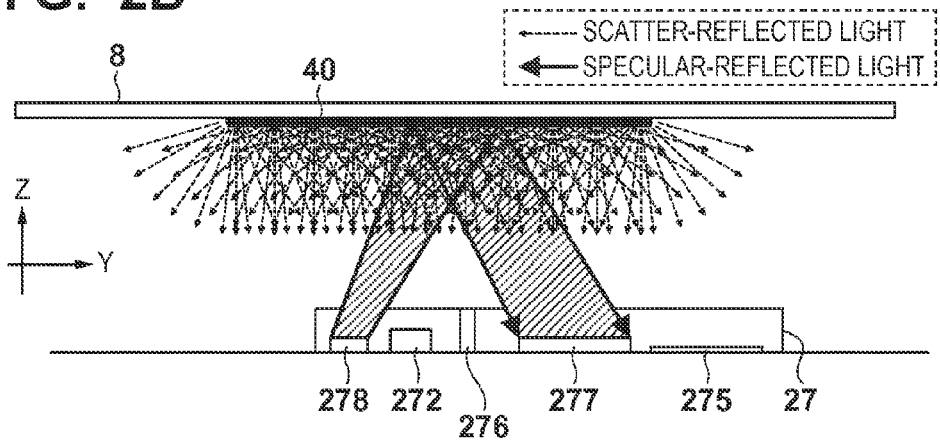
Figure 2C:
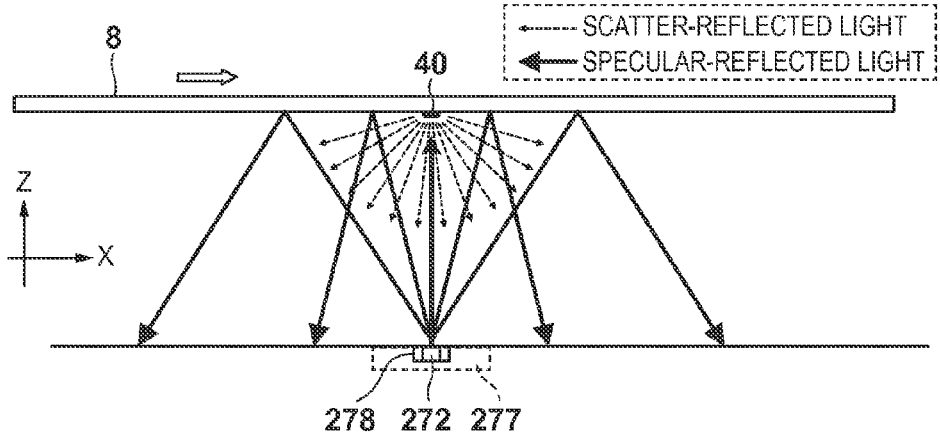

FIGS. 1B and 2B are views from the X-axis direction of FIGS. 1A and 2A. The intermediate transfer belt 8 travels from the far side to the near side in the drawings. FIGS. 1C and 2C are views from the Y-axis direction of FIGS. 1A and 2A. The intermediate transfer belt 8 travels in the direction of a hollow arrow in the drawings. Light emitted by the light-emitting element 272 or 278 is specular-reflected by the surface of the intermediate transfer belt 8 as indicated by the solid arrows. On the other hand, the light emitted by the light-emitting elements 272 and 278 is mainly scatter-reflected by the line portion of the detection image 40 on the intermediate transfer belt 8. This scatter-reflected light is indicated by the broken arrows. Note that as for the scatter reflection, the irradiation light from the light-emitting elements 272 and 278 to the detection image 40 is not illustrated to avoid cumbersomeness, and the scatter-reflected light components received by the light-receiving element 277 are indicated by short broken arrows.

Figure 3:
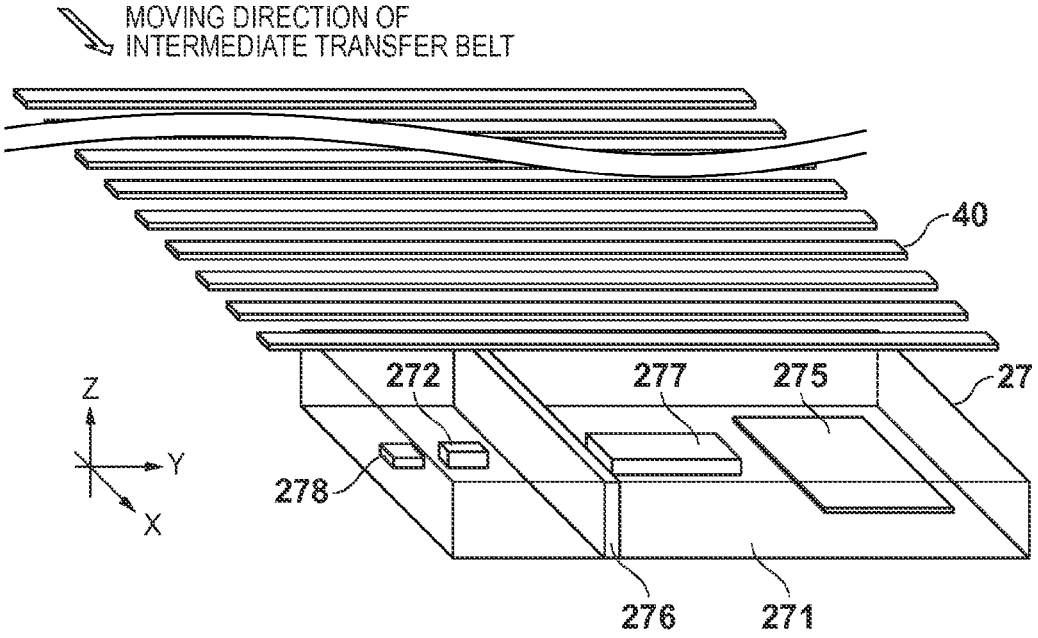
FIG. 3 is a perspective view showing the optical sensor and the detection image including a plurality of lines according to an embodiment.

The light-receiving amount of the optical sensor 27, that is, the photodetection signal output from the optical sensor 27 when the detection image 40 including lines by a plurality of toners is formed will be described next. Note that although the lines will be explained as solid lines, they may be discontinuous lines such as dotted lines or broken lines. FIG. 3 is a perspective view showing the optical sensor 27 and the detection image 40 including a plurality of lines formed on the intermediate transfer belt 8. For the sake of illustrative simplicity, the intermediate transfer belt 8 is not illustrated in FIG. 3. FIGS. 4A to 4D are graphs showing time-rate changes in the light-receiving amount of the light-receiving element 277 when the detection image 40 shown in FIG. 3 passes through the irradiation regions of the light-emitting elements 272 and 278 of the optical sensor 27. Note that the detection image 40 has a width of about 100 mm in the sub-scanning direction, that is, in the moving direction of the intermediate transfer belt 8. FIGS. 4A to 4D show time-rate changes in the light-receiving amount when the width of each line and the width of the region (to be referred to as a space hereinafter) between adjacent lines are set to different values. More specifically, the line width and space width are minimum in FIG. 4A, and increase in the order of FIGS. 4B, 4C, and 4D. Note that FIGS. 4A to 4D illustrate the toner lines and spaces under the waveforms for the sake of reference. The leftward/rightward direction of the drawings corresponds to the sub-scanning direction. FIGS. 4A to 4D show not only the total amount of light received by the light-receiving element 277 but also the scatter-reflected light amount thereof.

Figure 4A:
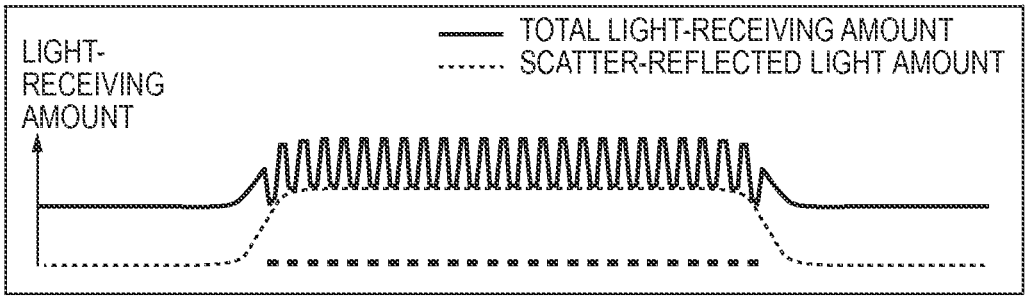
FIGS. 4A to 4D are graphs showing time-rate changes in the light-receiving amount upon detecting the detection image including a plurality of lines according to an embodiment.
Figure 4B:
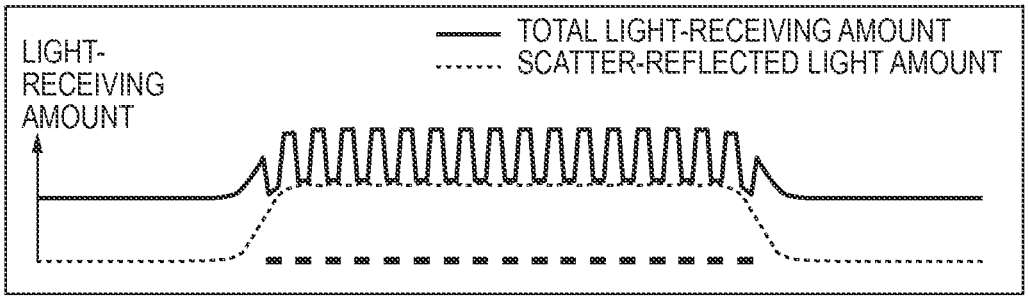
Figure 4C:
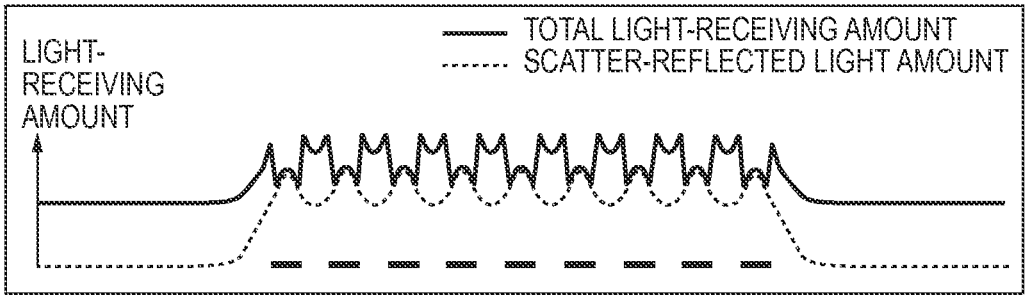
Figure 4D:
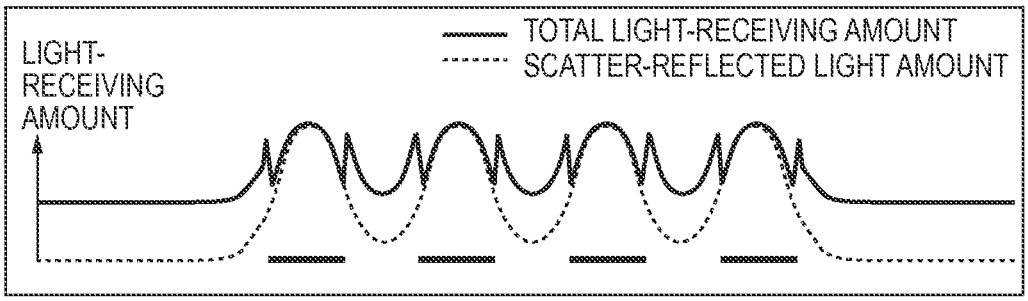

The scatter-reflected light components of the adjacent lines interfere with each other. The reflection state of the scatter-reflected light components of the entire detection image 40 is determined by the degree of interference. If the line pitch is large, and the space width is large, no even state is obtained even when the scatter-reflected light components interfere with each other, and an oscillating state is obtained. The line pitch is the distance between the centers of adjacent lines, which equals the sum of the line width and the space width. For example, oscillation is very large when the line pitch is larger than in the state of FIG. 4C. In the state of FIG. 4D, the scatter-reflected light components of the lines scarcely interfere with each other. To the contrary, in the state of FIG. 4B, oscillation of the scatter-reflected light components is very small. In the state of FIG. 4A, no oscillation occurs, and an almost even state is obtained. Note that the oscillation of the scatter-reflected light components changes depending on not only the line pitch but also the distance between the optical sensor 27 and the intermediate transfer belt 8. On the other hand, the specular-reflected light amount from the space portions of the detection image 40 oscillates in accordance with the line pitch. For this reason, the total light-receiving amount repetitively changes while being superimposed on the waveform of the scatter-reflected light indicated by the broken line.

Note that the lines shown in FIGS. 4A to 4D are formed at a density of almost 100%. When detecting the density, the lines are formed at a halftone density. In this case, although the scatter-reflected light components oscillate at the period of the line pitch, the oscillation amplitude value is smaller than that at the density of 100%. For example, when the density is 0%, the oscillation amplitude of the scatter-reflected light components is 0. When the density is 100%, the oscillation amplitude equals that in FIGS. 4A to 4D. When the density is the halftone density, an intermediate oscillation amplitude is obtained. That is, when the plurality of lines are formed under the condition that an almost predetermined amount of scatter-reflected light components is obtained at the density of 100%, an almost predetermined amount of scatter-reflected light components is obtained even at the halftone density.

A method of removing extracting scatter-reflected light components by a toner from the total light-receiving amount detected by the optical sensor 27 and extracting specular-reflected light components will be described next with reference to FIGS. 5A to 5C, 6A and 6B, and 7.

Figure 5A:
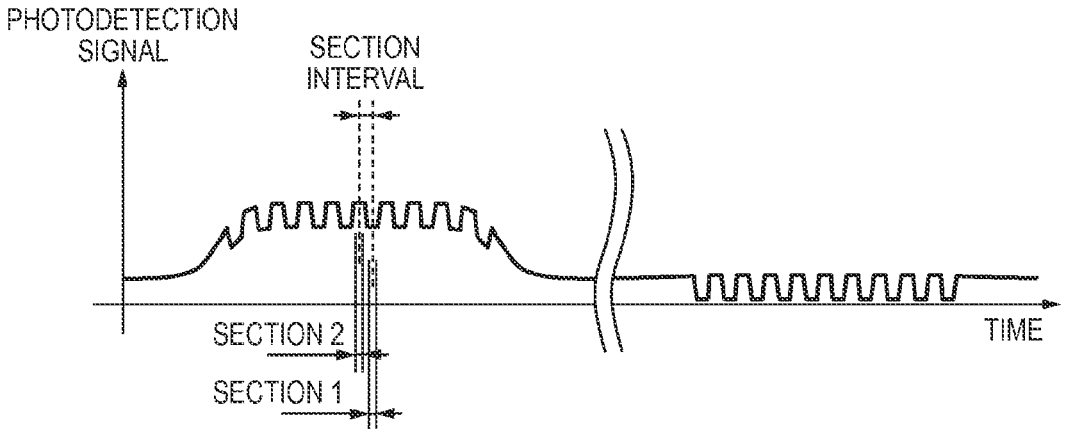
FIGS. 5A to 5C are explanatory views of processing for the detection image including a plurality of lines according to an embodiment.
Figure 5B:
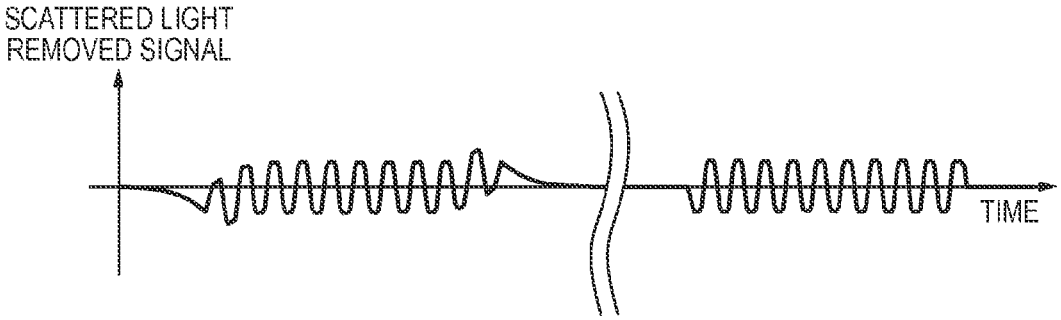
Figure 5C:
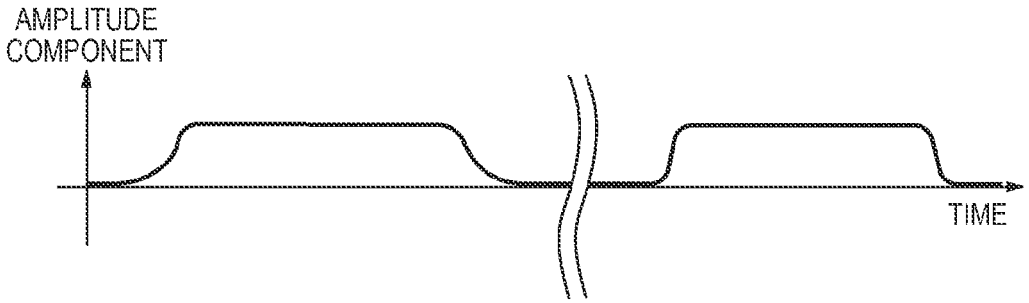

FIGS. 5A to 5C are explanatory views of processing for the photodetection signal output from the optical sensor 27, and can mainly be used to detect the density. Note that FIGS. 5A to 5C illustrate both signals (left side of drawings) for the detection image 40 formed by toner of a color that generates a large amount of scatter-reflected light and signals (right side of drawings) for the detection image 40 formed by toner of a color that generates a small amount of scatter-reflected light. Note that the space width of the detection image 40, the distance between the optical sensor 27 and the intermediate transfer belt 8, and the like are adjusted such that the oscillation of the scatter-reflected light amount falls within a predetermined range.

FIG. 5A shows the photodetection signal output from the optical sensor 27. In the detection image 40 of the color that generates a large amount of scatter reflection, the whole waveform is raised by the influence of the scatter-reflected light, as in FIG. 4A. In the detection image 40 of the color that generates a small amount of scatter reflection, since the irradiation light is absorbed by the toner, the waveform oscillates while being raised a little.

FIG. 5B shows a waveform obtained by, for example, setting two sections at a section interval almost ½ the oscillation period of the photodetection signal, obtaining a moving average value in each of the two sections, and further performing differential processing for the moving average values in the two sections. As described above, the detection image 40 is formed such that the oscillation of the scattered light falls within a predetermined range. For this reason, the oscillation of the photodetection signal shown in FIG. 5A is mainly the oscillation of the specular-reflected light amount. Hence, when differential processing for the two sections is performed, the scatter-reflected light components are removed or suppressed to a predetermined amount or less. That is, the signal shown in FIG. 5B is a scattered light removed signal obtained by removing the scattered light components from the total light-receiving amount. The amplitude of the scattered light removed signal indicates the line and space of the detection image, that is, the contrast of reflected light from the surface portion of the intermediate transfer belt 8, that is, the density information of the toner. For example, when the density of the line of the detection image 40 is lowered, the amplitude of the waveform shown in FIG. 5B becomes small.

FIG. 5C shows the amplitude value extracted from the scattered light removed signal in FIG. 5B, which can be used as density information. Note that since the scatter-reflected light component is not even neat the start and end of detection of the detection image 40, the waveform is slightly distorted in the detection image 40 that generates a large amount of scatter reflection, as shown in FIG. 5B. If the amplitude value is extracted from the distorted waveform portion, an error occurs. To prevent this, the detection image 40 is made long to some extent in the sub-scanning direction, and a state in which the scatter-reflected light amount is even is ensured. When the scatter-reflected light component is even, the amplitude value can accurately be extracted from that portion. That is, it is possible to detect accurate density information.

Figure 6A:
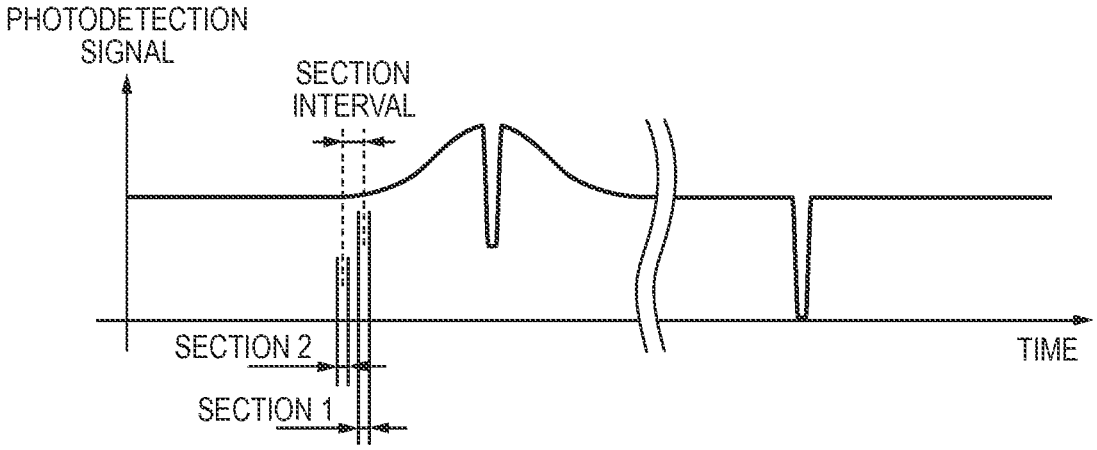
FIGS. 6A and 6B are explanatory views of processing for the detection image including one line according to an embodiment.
Figure 6B:
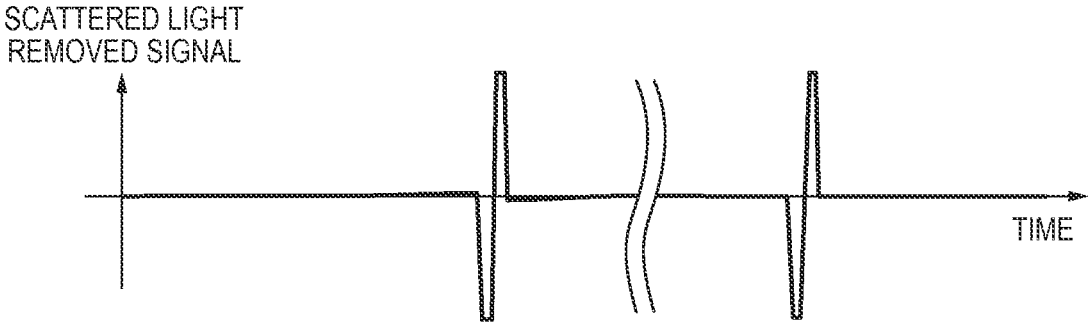

FIGS. 6A and 6B are explanatory views of a photodetection signal when the detection image 40 including one line is used, unlike FIGS. 5A to 5C, and processing thereof. The detection image 40 including one line can be used to detect, for example, color misalignment. Note that like FIGS. 5A to 5C, FIGS. 6A and 6B illustrate both a case (left side of drawings) in which the detection image 40 is formed by toner of a color that generates a large amount of scatter-reflected light and a case (right side of drawings) in which the detection image 40 is formed by toner of a color that generates a small amount of scatter-reflected light. As shown in FIG. 6A, in the detection image 40 including one line, when the line has reached the position where the light-receiving element 277 receives specular-reflected light, the light-receiving amount attenuates. Note that as shown in FIG. 6A, when the scatter-reflected light amount is large, the light-receiving amount increases before and after the decrease in the specular-reflected light amount caused by the influence of the scatter-reflected light.

FIG. 6B shows a signal waveform obtained by providing two sections, obtaining a moving average value in each of the two sections, and further performing differential processing for the moving average values, as in the detection image 40 including a plurality of lines. In the signal waveform shown in FIG. 6B, the scatter-reflected light is almost removed, and correction to almost the same waveform is performed regardless of the amount of scatter reflection of the toner. In the detection image 40 including one line, the scatter-reflected light amount is not constant when the detection image 40 passes through the detection region of the optical sensor 27. For this reason, a small amount of scattered light components remains in the scatter-reflected light removed signal shown in FIG. 6B. This poses no problem when detecting the color misalignment amount because the object is to detect the passing timing of the detection image 40. However, to prevent the remaining scatter-reflected light components from being problematic, the width of time to cause the detection image 40 to pass through the detection region of the optical sensor 27 can be made much smaller than the width of time to detect the scatter-reflected light. When the signal shown in FIG. 6B is compared with a predetermined threshold, and timing data is generated, the arrival timing, that is, the position information of the detection image 40 can be detected. In this embodiment, the density information or position information of the detection image 40 of each color can be detected by the same processing regardless of the amount or presence/absence of scatter reflection of the toner. Note that even in the detection image 40 including a plurality of lines shown in FIGS. 5A and 5B, the arrival timing can be detected by comparing the signal shown in FIG. 5B or 5C with a predetermined threshold.

Figure 7:
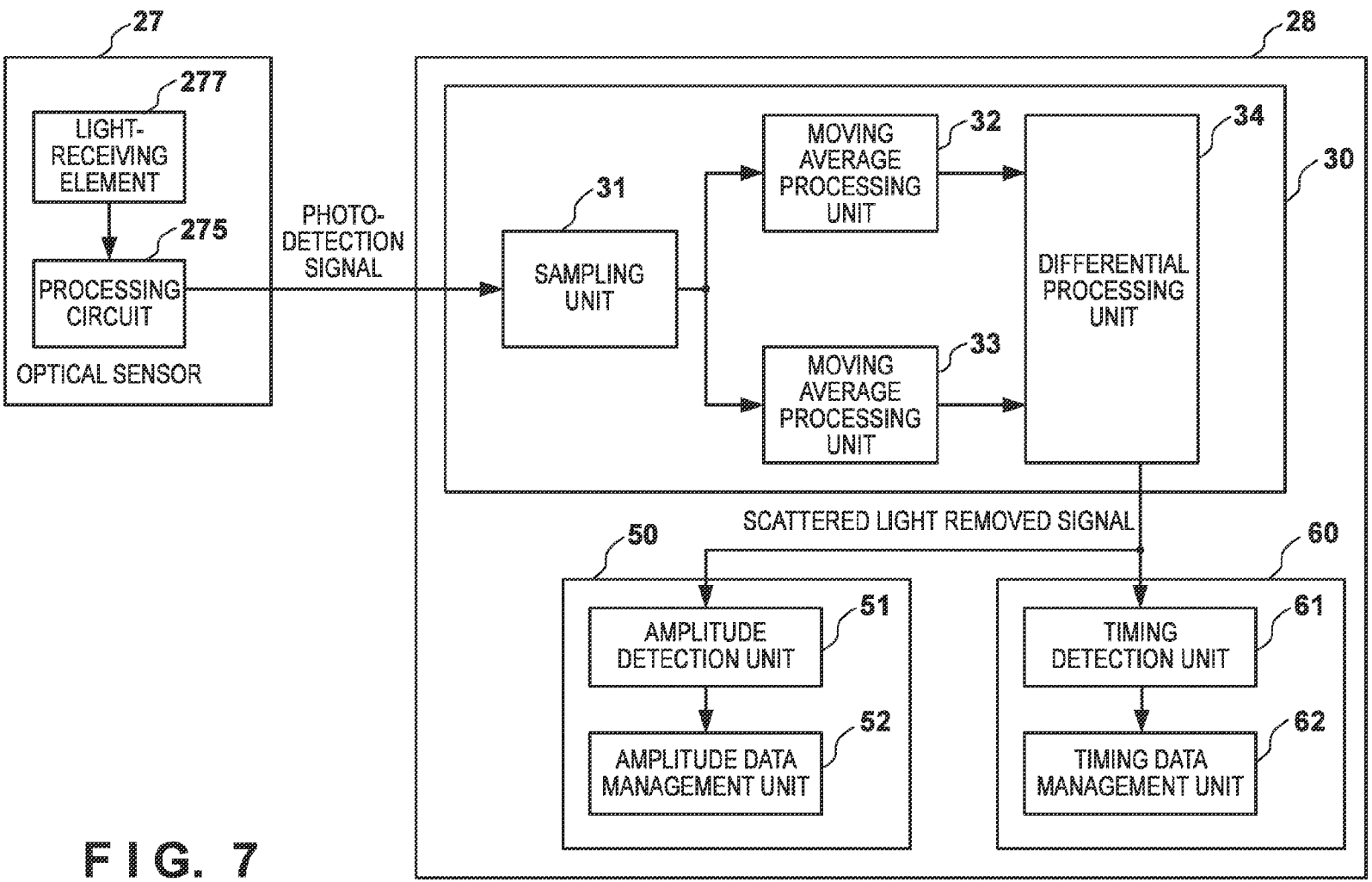
FIG. 7 is a block diagram showing the schematic arrangement of a detection system according to an embodiment.

FIG. 7 shows an exemplary detection system that performs the processes described with reference to FIGS. 5A to 5C, 6A, and 6B. The optical sensor 27 includes the light-receiving element 277 that detects reflected light from the intermediate transfer belt 8 and the detection image 40 on the intermediate transfer belt 8, and the processing circuit 275 that converts a current corresponding to the light-receiving amount output from the light-receiving element 277 into a voltage and outputs it as a photodetection signal. A signal processing unit 28 is provided in the engine control unit 25 shown in FIG. 16, and includes a scattered light removing unit 30 that generates a scattered light removed signal by removing scatter-reflected light components from the photodetection signal. The signal processing unit 28 also includes an amplitude data generation unit 50 that extracts the amplitude data of the scattered light removed signal, and a timing data generation unit 60 that generates the arrival timing data of the scattered light removed signal.

A sampling unit 31 in the scattered light removing unit 30 samples the photodetection signal. Each of moving average processing units 32 and 33 calculates the moving average value in a section of the sampled photodetection signal. More specifically, the moving average processing unit 32 calculates the moving average value in section 1 shown in FIG. 5A or 6A, and the moving average processing unit 33 calculates the moving average value in section 2 shown in FIG. 5A or 6A. A differential processing unit 34 performs a differential operation of the moving average values calculated by the moving average processing units 32 and 33, thereby generating a scattered light removed signal in which the scatter-reflected light components cancel each other so as to be removed or suppressed. Note that the period, that is, the interval between the sections in which the moving average processing units 32 and 33 calculate the moving average values is set to a value according to the pitch of the lines of the detection image 40 including a plurality of lines. For example, the sections can be set to sections including positions where the photodetection signal has different amplitudes. For example, the interval between the two sections can be set such that the moving average processing unit 33 obtains the moving average in a section including the minimum value of the total light-receiving amount in FIG. 5A while the moving average processing unit 32 obtains the moving average in a section including the maximum value of the total light-receiving amount in FIG. 5A.

Note that although a form in which the difference between the moving averages in the two sections is obtained has been described above, the difference between the sum of the moving averages in a plurality of first sections and the sum of the moving averages in a plurality of second sections may be obtained. For example, the intervals between a total of six sections can be set such that the moving average in each of three second sections including different minimum values of the total light-receiving amount is obtained while the moving average in each of three first sections including different maximum values of the total light-receiving amount in FIG. 5A is obtained. In addition, not the average value in a section but the difference between given time positions, that is, the difference between a first time position and a second time position may be obtained. Note that the number of sections, the length of each section, and the intervals between the sections can be set to various values other than those described above. However, a state capable of detecting the contrast generated by the presence/absence or density difference of the detection image 40 formed on the intermediate transfer belt 8 is basically set. In this embodiment, the simplest arrangement in which two sections are set will be exemplified. However, any other number of sections can be set. In addition, not the average value in a section but each sampling value of the photodetection signal may undergo the differential processing.

The scattered light removed signal output from the scattered light removing unit 30 is input to the amplitude data generation unit 50 and the timing data generation unit 60. An amplitude detection unit 51 in the amplitude data generation unit 50 detects the amplitude value of the scattered light removed signal. The detected amplitude value of the scattered light removed signal is stored by an amplitude data management unit 52 and managed as data corresponding to the intensity of the reflected light from the detection image 40, for example, density information. A timing detection unit 61 in the timing data generation unit 60 detects the timing at which the scattered light removed signal exceeds a threshold. The detected timing data is position information corresponding to the formation position of the detection image 40, which can be handled as color misalignment information by managing the relative relationship of timing data with respect to the detection image 40 of each color.

For example, when the density information is fed back to the voltage condition of each bias or a process formation condition such as laser power, the maximum density or halftone characteristic of each color is corrected. In addition, when the print start positions in the main scanning direction and sub-scanning direction and the image clock are adjusted for each color based on the color misalignment information, the color misalignment is corrected. Note that the lines include not only a solid line but also a discontinuous line such as a broken line or a dotted line, as described above. In the above-described embodiment, the line of the detection image 40 is perpendicular to the moving direction of the intermediate transfer belt 8. However, the line may be drawn, for example, obliquely with respect to the perpendicular direction. That is, the detection image 40 need only be an image whose toner amount (developing material amount) periodically changes in the moving direction of the intermediate transfer belt 8, and can include a line in a direction different from the moving direction of the detection image 40.

The optical sensor 27 according to this embodiment includes no converging mechanism of light. For this reason, the optical sensor can be downsized to a fraction of the conventional size, and can generate a signal in which the scattered light components from the detection image 40 are accurately removed or attenuated. In addition, since no converging mechanism exists, the detection resolution can be increased without posing a problem by variations in the manufacture. Furthermore, since the detection resolution is high, the size of the image used to detect color misalignment or density can be made small.

Note that the signal waveforms shown in FIGS. 5A to 5C, 6A, and 6B are obtained when the intermediate transfer belt 8 having a very smooth surface is used. However, many intermediate transfer belts 8 have an uneven surface. This unevenness causes fluctuation (to be referred to as belt surface noise hereinafter) in the photodetection signal. In the optical sensor 27 exemplified in this embodiment, the light-emitting region of the light-emitting elements 272 and 278 and the light-receiving region of the light-receiving element 277 have sizes of several ten to several hundred μm. For this reason, if unevenness in a size of several ten to several hundred μm exists on the surface of the intermediate transfer belt 8, relatively large belt surface noise is generated. When the belt surface noise is superimposed on the photodetection signal, the amplitude detection accuracy may lower. Hence, in density detection or the like in which the amplitude detection accuracy is important, generation of the belt surface noise is suppressed.

Figure 8A:
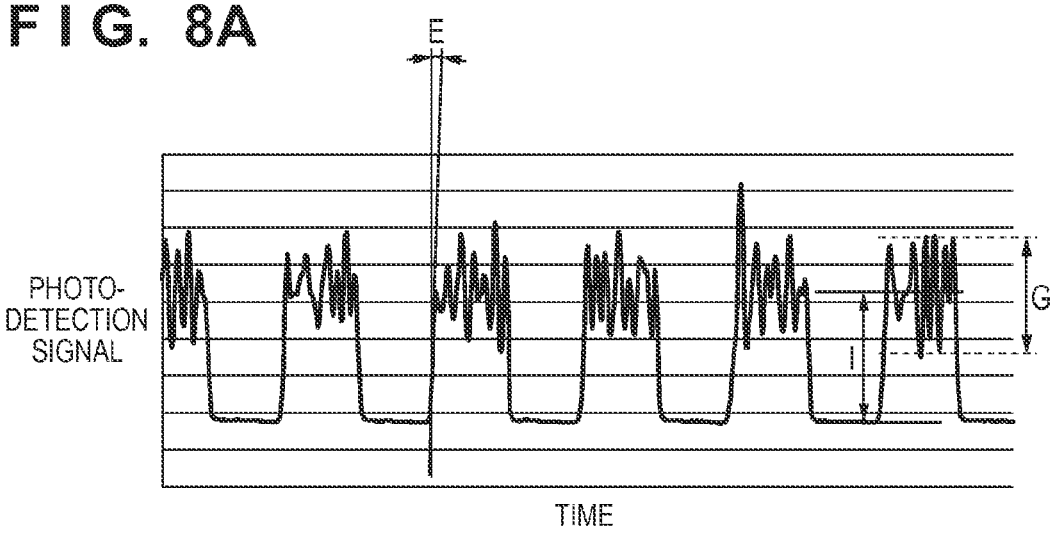
FIGS. 8A and 8B are explanatory views of the relationship between a light-emitting region and the leading edge of a photodetection signal.
Figure 8B:
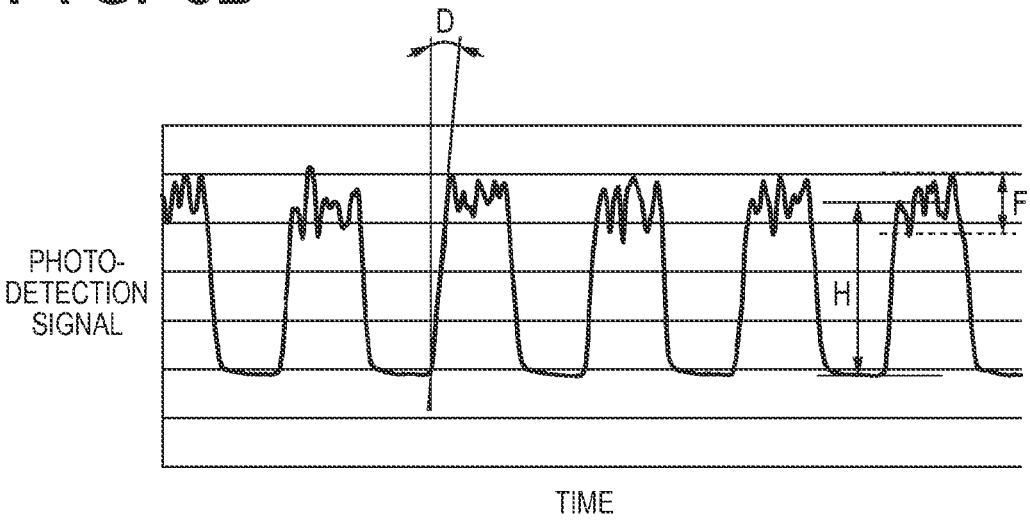

FIGS. 8A and 8B show photodetection signals when unevenness in a size of several ten to several hundred μm exists on the surface of the intermediate transfer belt 8. FIG. 8A shows the waveform of the photodetection signal when the detection image 40 is detected by turning on only the light-emitting element 272 having a smaller light-emitting region (to be referred to as a light source size hereinafter). FIG. 8B shows the waveform of the photodetection signal when the detection image 40 is detected by turning on only the light-emitting element 278 having a larger light source size. An amplitude I in FIG. 8A and an amplitude H in FIG. 8B are signal amplitudes. An amplitude G in FIG. 8A and an amplitude F in FIG. 8B are the amplitudes of superimposed belt surface noise. Angles E and D are the rising angles of the waveforms. When the light-emitting element 278 having the large light source size is used, light reflected by the unevenness of the surface of the intermediate transfer belt 8 is averaged, the belt surface noise (amplitude F) is made relatively small, as compared to FIG. 8A. In addition, when the light-emitting element 278 having the large light source size is used, the waveform moderately rises and falls. From FIGS. 8A and 8B, when the light source size is reduced, the belt surface noise becomes large. However, since the waveform sharply rises and falls, the detection accuracy of the arrival timing of the detection image 40 is improved. Furthermore, the detection image can be made small. On the other hand, when the light source size becomes large, the belt surface noise becomes small and the detection accuracy of the amplitude of the photodetection signal is improved.

That is, I/G and H/F that are signal-to-noise ratios (S/N ratios) of the signals shown in FIGS. 8A and 8B hold a relation given by $$H/F>I/G$$

Hence, to give higher priority to the amplitude accuracy than the arrival timing accuracy of the detection image 40, switching is effectively done to turn on the light-emitting element 278 having the large light-emitting size to obtain a higher S/N ratio. Conversely, to give higher priority to the arrival timing accuracy than the amplitude accuracy of the detection image 40, switching is effectively done to turn on the light-emitting element 272 having the small light-emitting size to make the waveform quickly rise and fall.

Figure 9:
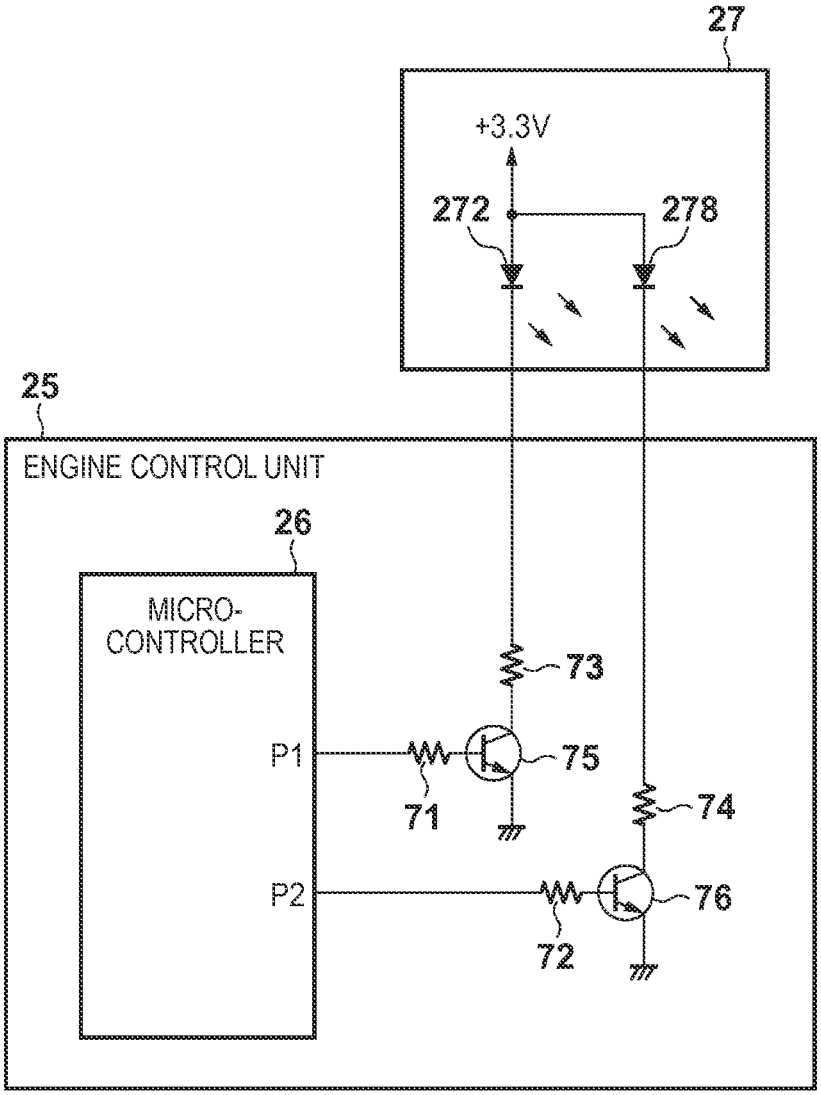
FIG. 9 is a block diagram showing the control arrangement of a light-emitting element according to an embodiment.

A circuit configured to switch the light-emitting element will be described next with reference to FIG. 9. In the circuit shown in FIG. 9, a transistor 75 on/off-controls the light-emitting element 272. Note that a resistor 71 is the base resistor of the transistor 75, and a resistor 73 is used to restrict the current to the light-emitting element 272. A transistor 76 on/off-controls the light-emitting element 278. Note that a resistor 72 is the base resistor of the transistor 76, and a resistor 74 is used to limit the current to the light-emitting element 278. The microcontroller 26 changes a terminal P1 to high level to cause the light-emitting element 272 to emit light, and changes a terminal P2 to high level to cause the light-emitting element 278 to emit light.

Figure 10:
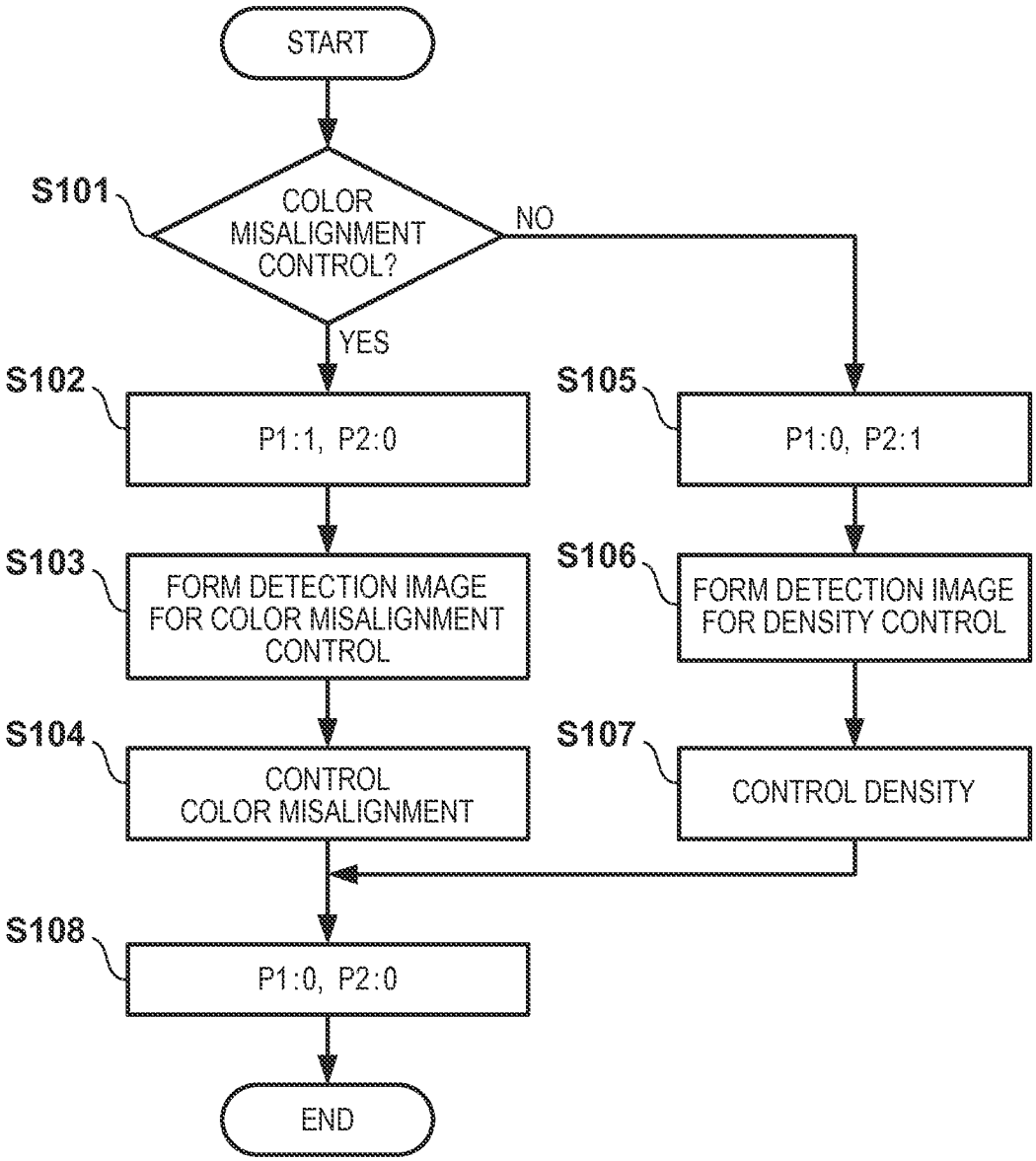
FIG. 10 is a control flowchart of the light-emitting element according to an embodiment.

Light emission control processing of the light-emitting element performed by the microcontroller 26 will be described next with reference to FIG. 10. Note that in color misalignment control, the light-emitting element 272 having the small light source size is used to give priority to the arrival timing of the detection image 40. On the other hand, in density control, the light-emitting element 278 having the large light source size is used to give priority to the accuracy of the amplitude of the photodetection signal corresponding to the density. However, the relationship between the type of control and the size of the light source to be used is not limited to this. First, in step S101, the microcontroller 26 determines the control contents. For color misalignment control, the microcontroller 26 sets the terminal P1 to "high" and the terminal P2 to "low" in step S102. The light-emitting element 272 having the small light source size thus emits light, and the light-emitting element 278 having the large light source size is turned off. After that, the microcontroller 26 forms the detection image 40 in step S103, and performs color misalignment control in step S104. On the other hand, upon determining to perform density control in step S101, the microcontroller 26 sets the terminal P1 to "low" and the terminal P2 to "high" in step S105. The light-emitting element 272 having the small light source size is thus turned off, and the light-emitting element 278 having the large light source size emits light. After that, the microcontroller 26 forms the detection image 40 in step S106, and performs density control in step S107. After the end of control, the microcontroller 26 turns off both the light-emitting elements 272 and 278 in step S108.

As described above, the detection resolution is switched by on/off-controlling a plurality of light-emitting elements, thereby ensuring the detection accuracy necessary for detection control. Note that in the above description, a plurality of light-emitting elements having different light source sizes are provided, thereby making it possible to switch the light source size. However, the arrangement is not limited to this if light source size switching is possible. For example, the light source size can be made small by providing a plurality of light-emitting elements having the same light source size and blocking some or all of the divergent beams of some light-emitting elements.

Switching the detection resolution by on/off-controlling a plurality of light-emitting elements is also effective even when higher priority is given to downsizing of the detection image 40 than the arrival timing accuracy or the amplitude accuracy. For example, color misalignment and density detection are often performed, for example, immediately after powering on the main body or after a predetermined number of sheets are printed, as in the related art. For example, various kinds of techniques have been proposed to correct color misalignment or density by sequentially executing calibration while performing continuous printing without lowering the productivity during continuous printing in a non-image forming region between the trailing edge of an image and the leading edge of the next image (also referred to as between images or between sheets). In this case, to form the detection image 40 in a limited space between the sheets, downsizing of the detection image 40 is effective.

Second Embodiment

In the first embodiment, the two light-emitting elements having different light source sizes are switched, thereby switching the resolution. In the second embodiment, additionally, the pitch of the lines of a detection image 40 is changed to improve the S/N ratio. This embodiment will be described below mainly concerning the difference from the first embodiment.

Figure 11:
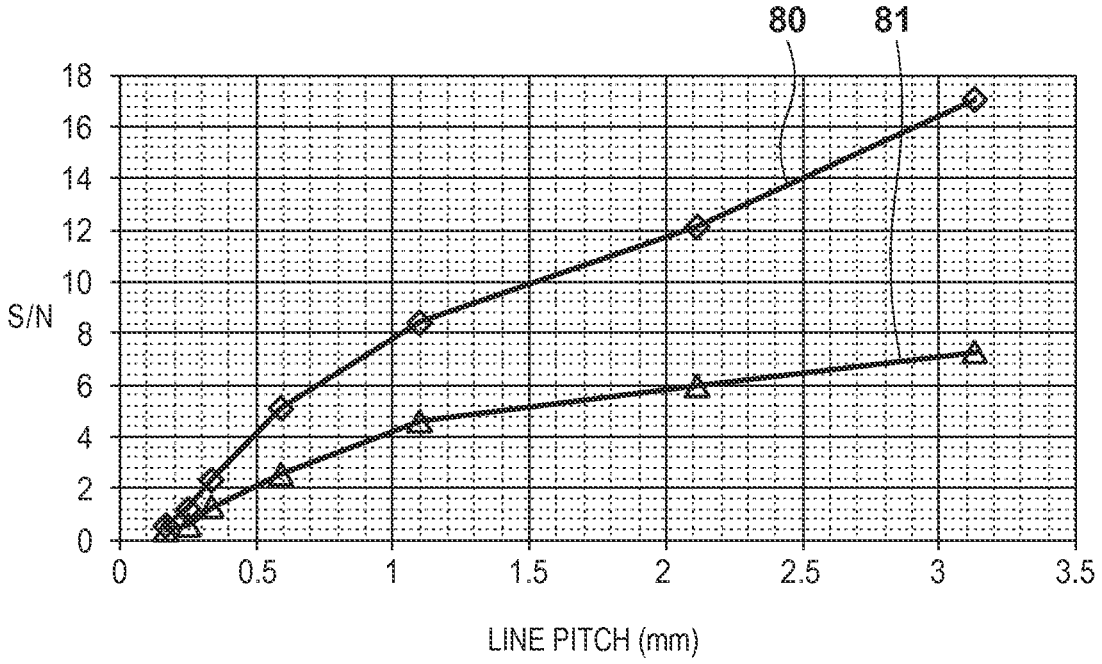
FIG. 11 is a graph showing the relationship between the line pitch and the S/N ratio according to an embodiment.

FIG. 11 is a graph showing the S/N ratio when one of the light-emitting elements is turned on, and the detection image 40 having various line pitches is measured. Note that the line pitch indicates the distance between the centers of adjacent lines, that is, the sum of the line width and the space width. Note that reference numeral 80 indicates a graph when only a light-emitting element 278 is turned on, and reference numeral 81 indicates a graph when only a light-emitting element 272 is turned on. As already described above, the larger the light source size is, the higher the S/N ratio is. As shown in FIG. 11, when the line pitch of the detection image 40 increases, the S/N ratio is improved. Hence, the detection performance can further be improved not only by changing the line pitch, the line width, or space width of the detection image 40 but also by on/off-controlling the plurality of light-emitting elements.

Third Embodiment

In the first embodiment, the light source size is switched, thereby suppressing the influence of belt surface noise. In this embodiment, the detection resolution is switched by shaping a waveform by applying a low-pass filter to a photodetection signal without or in addition to switching of the light source size. Note that in this embodiment, a raw signal is used to control color misalignment without applying the low-pass filter. However, a plurality of low-pass filters may be provided, and a low-pass filter having a high cutoff frequency may selectively be used in color misalignment control. This embodiment will be described below mainly concerning the difference from the first embodiment.

Figure 12:
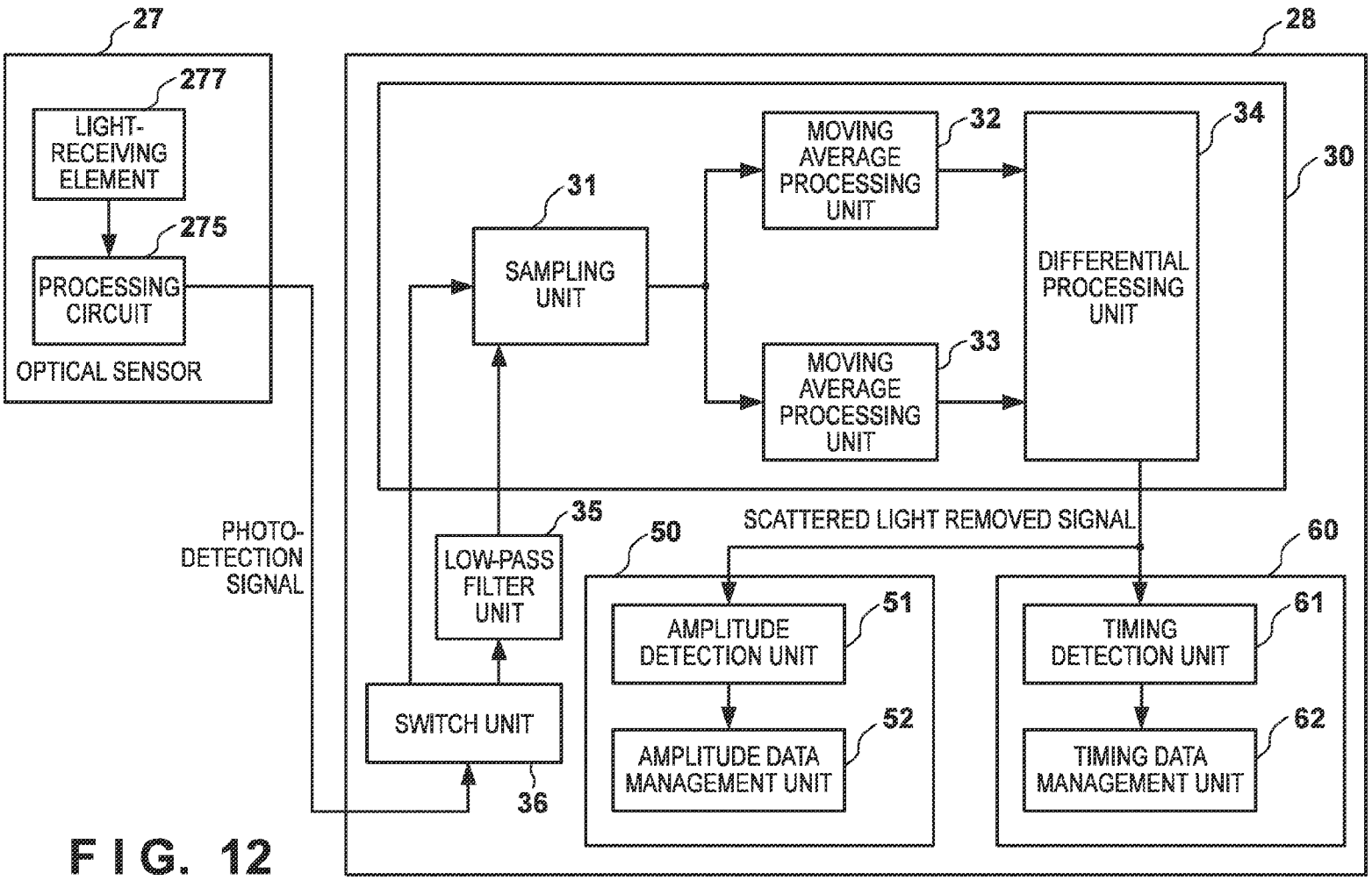
FIG. 12 is a block diagram showing the schematic arrangement of a detection system according to an embodiment.

FIG. 12 is a block diagram showing of a detection system according to this embodiment. As compared to the block diagram of the first embodiment shown in FIG. 7, a switch unit 36 and a low-pass filter unit 35 are added. To give higher priority to the accuracy of the arrival timing of a detection image 40, the switch unit 36 outputs the photodetection signal to a sampling unit 31. On the other hand, to give higher priority to the amplitude accuracy of the photodetection signal, the switch unit 36 outputs the photodetection signal to the low-pass filter unit 35. The low-pass filter unit 35 outputs the photodetection signal that has passed through the low-pass filter to the sampling unit 31.

Figure 13A:
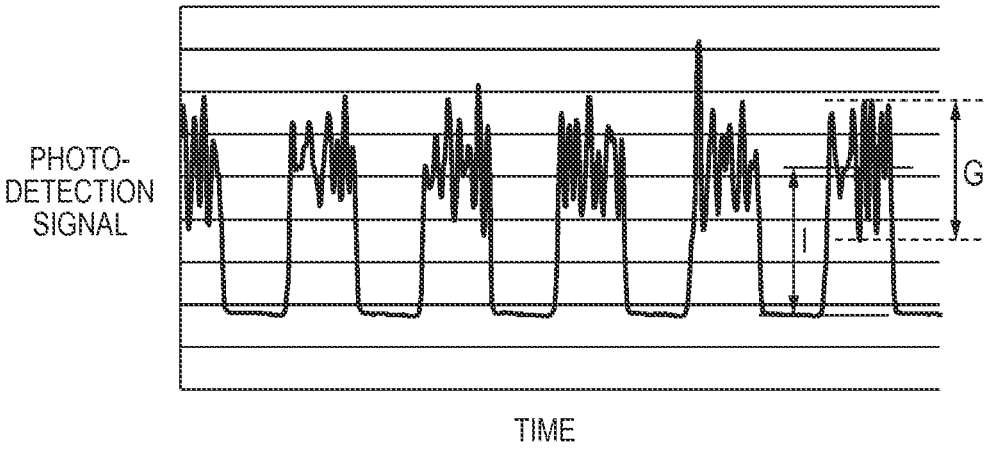
FIGS. 13A and 13B are explanatory views of processing for a photodetection signal according to an embodiment.
Figure 13B:
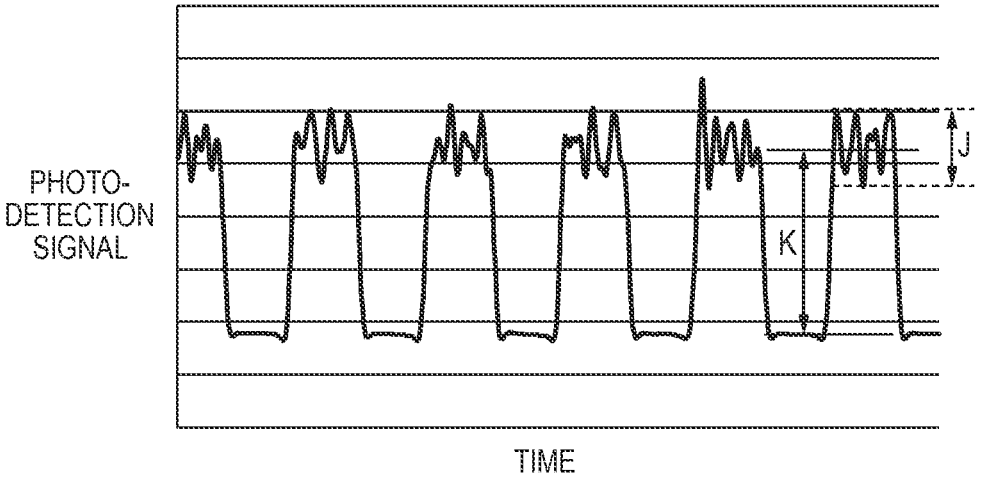

FIG. 13A shows a signal waveform obtained by turning on a light-emitting element 272 and measuring the detection image 40, as in FIG. 8A. FIG. 13B shows a signal waveform obtained by applying the low-pass filter to the photodetection signal shown in FIG. 13A. In FIG. 13B, although the leading and trailing edges of the waveform are rounded, belt surface noise (amplitude J) becomes small, and the amplitude detection accuracy is improved.

Fourth Embodiment

In this embodiment, the sub-scanning direction width (to be referred to as a detection width hereinafter) of the light-receiving region of the light-receiving element is switched, thereby switching the detection resolution. Note that switching of the detection width of the light-receiving element is done by arranging a plurality of light-receiving elements in the sub-scanning direction and switching the number of light-receiving elements to be used.

Figure 14:
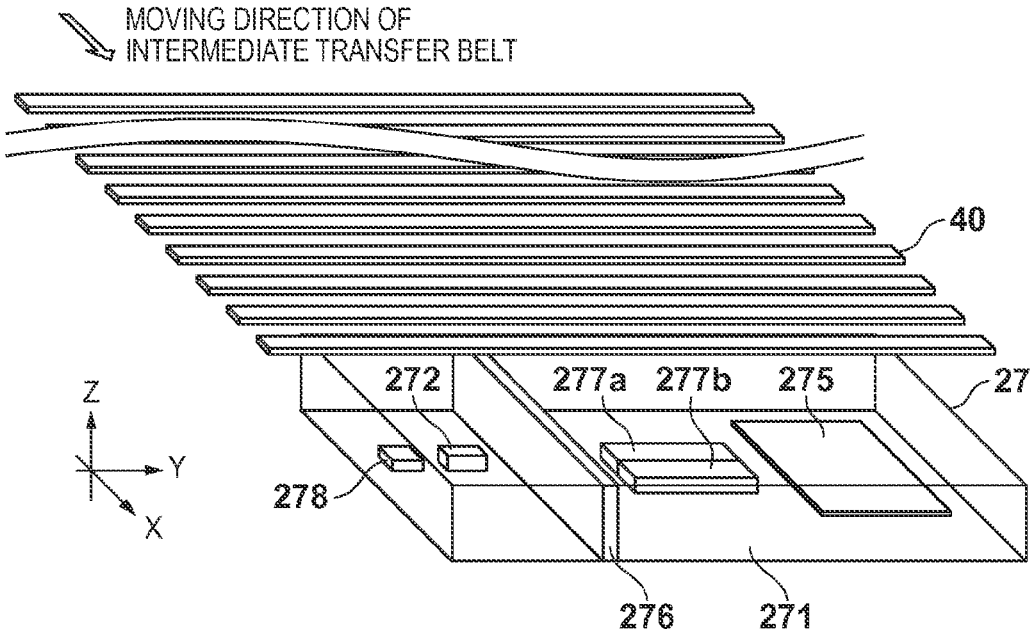
FIG. 14 is a perspective view showing an optical sensor and a detection image including a plurality of lines according to an embodiment.

FIG. 14 is a perspective view of an optical sensor 27 according to this embodiment. Note that the same reference numerals as in the first embodiment denote the same constituent elements, and a description thereof will be omitted. A light-receiving element 277*a* and a light-receiving element 277*b* are arranged at adjacent positions in the moving direction of the surface of an intermediate transfer belt 8. Components other than the light-receiving elements 277*a* and 277*b* are the same as in the first embodiment.

Figure 15:
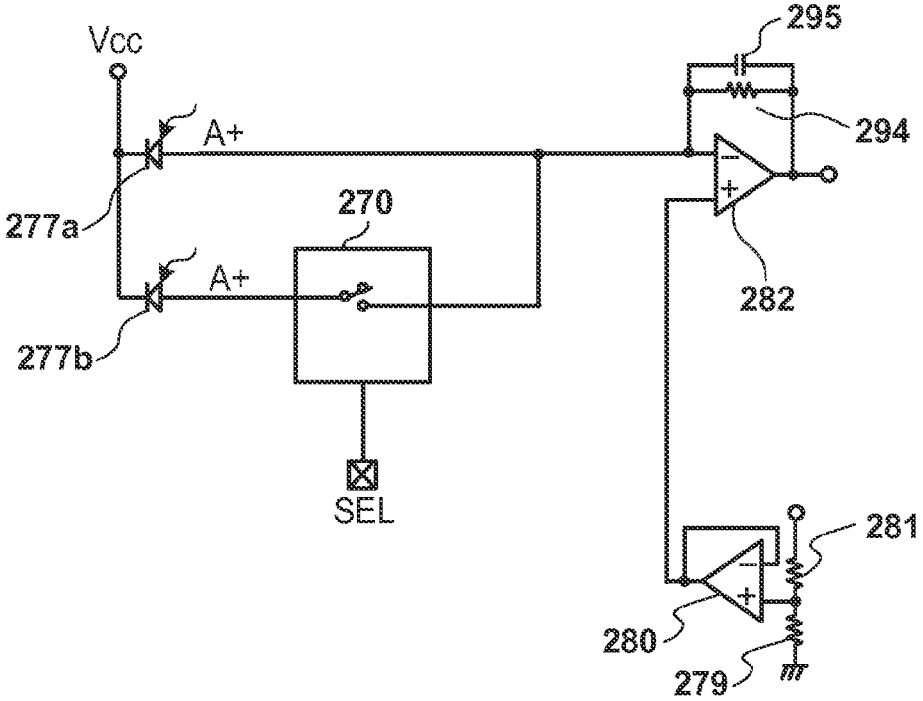
FIG. 15 is a control circuit diagram of an exemplary light-receiving element according to an embodiment.

FIG. 15 shows the electrical connection configuration of the light-receiving elements 277*a* and 277*b* of the optical sensor 27. An IV conversion amplifier 282 configured to add currents corresponding to the light-receiving amounts of the light-receiving elements 277*a* and 277*b* and convert the current into a voltage is provided. A voltage follower circuit formed from an operational amplifier 280 and resistors 281 and 279 supplies the reference voltage of the IV conversion amplifier 282. Note that a resistor 294 that connects the inverting input terminal and the output terminal of the IV conversion amplifier 282 is used for IV conversion, and a capacitor 295 is used for phase compensation and noise removal. A switch 270 is a selection circuit configured to control the number of light-receiving elements to be used. Note that the switch 270 is controlled by a microcontroller 26. Note that although the two light-receiving elements are switched in the above description, one or more light-receiving elements can be selected from an arbitrary number of two or more light-receiving elements and used.

As shown in FIG. 15, when the detection width is switched by electrically controlling one or more light-receiving elements, the detection resolution can be switched. This makes it possible to ensure optimum detection performance corresponding to the necessary accuracy. More specifically, when both the light-receiving elements 277*a* and 277*b* are used, the noise decreases although the leading edge of the photodetection signal is rounded, as compared to a case in which only the light-receiving element 277*a* is used. Hence, to give higher priority to the signal-to-noise ratio of the photodetection signal, two light-receiving elements are used. To give higher priority to the speed of rise of the photodetection signal, one light-receiving element is used. Note that the number of light-receiving elements to be used is not limited to two, and a plurality of light-receiving elements may be arranged in the sub-scanning direction, and an arbitrary number of continuous light-receiving elements may be selected.

Other Embodiments

Note that in all of the first to fourth embodiments, differential processing for two sections of one photodetection signal is performed. At this time, the size of the light-emitting region or the size of the light-receiving region is switched, waveform shaping is applied to the photodetection signal, or the line pitch is changed in accordance with the characteristic of the photodetection signal necessary for detection control. Note that performing differential processing for two sections of one photodetection signal is equivalent to calculating the difference in the reflected light amount including specular-reflected light components from different positions of the detection image 40 and the surface of the intermediate transfer belt 8 around it. Hence, the scattered light removed signal can also be generated by arranging a first light-receiving element and a second light-receiving element in the moving direction of the intermediate transfer belt 8 and performing differential processing for a first detection signal from the first light-receiving element and a second detection signal from the second light-receiving element at the same time position. This is because the specular-reflected light components received by the two light-receiving elements at the same time come from different positions of the detection image 40 and the surface of the intermediate transfer belt 8 around it. In the arrangement for performing differential processing for the two light-receiving elements at the same time, the sub-scanning direction width of the light-receiving region of the light-receiving element corresponds to the width of the section to obtain the moving average in the first embodiment. The arrangement interval of the first light-receiving element and the second light-receiving element corresponds to the interval of the sections to perform differential processing in the first embodiment. In the first embodiment, differential processing can also be performed for the sum of the average values in a plurality of sections and the sum of the average values in the plurality of sections, as described above. This is equivalent to alternately arranging a plurality of first light-receiving elements and a plurality of second light-receiving elements and performing differential processing for the sum of the light-receiving amounts of the plurality of first light-receiving elements and the sum of the light-receiving amounts of the plurality of second light-receiving elements. The filter shown in FIG. 12 can be applied to each of the first detection signals and the second detection signals. Switching of the light-receiving region size described in the fourth embodiment can be also applied to each of the first light-receiving elements and the second light-receiving elements.

Both differential processing for different time positions of the photodetection signal from one light-receiving element and differential processing for the same time position of the photodetection signals from two light-receiving elements can be regarded as differential processing performed while shifting the phase of the photodetection signal. More specifically, when one light-receiving element is used, the above-described processing is equivalent to branching one photodetection signal into two signals, delaying one photodetection signal by a predetermined amount, and performing differential processing. The predetermined amount to be delayed equals the section interval in the first embodiment. Instead of simply shifting the phase, the differential processing may be performed after moving average processing, as a matter of course. When two light-receiving elements are used, the photodetection signals output from the two light-receiving elements have phases shifted from each other. In this case, the phase difference corresponds to the distance between the arrangement positions of the two light-receiving elements.

Note that the present invention has been explained using an image forming apparatus as an example. However, the present invention can also be implemented as a detection apparatus capable of being implemented in an image forming apparatus or the like.

Aspects of the present invention can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (for example, computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-277444, filed on Dec. 19, 2012, which is hereby incorporated by reference herein in its entirety.

The invention claimed is:

1. A detection apparatus comprising:

an irradiation unit configured to irradiate an image carrier on which a detection image made of a developing material is formed with light, said irradiation unit being capable of switching a size of a light-emitting region to emit the light to irradiate;

a light-receiving unit configured to receive reflected light of the light irradiated by said irradiation unit and output a detection signal corresponding to a light-receiving amount of the reflected light including a specular-reflected light component;

a detection unit configured to detect one of position information and density information of the detection image based on a signal corresponding to a difference between a value of the detection signal corresponding to the light-receiving amount of the reflected light from a first position where the detection image is formed and the value of the detection signal corresponding to the light-receiving amount of the reflected light from a second position different from the first position during a time when the detection image formed on said image carrier passes through an irradiation region of said irradiation unit; and a control unit configured to control to switch the size of the light-emitting region of said irradiation unit to detect one of the position information and the density information of the detection image.

2. An image forming apparatus comprising:

an image carrier;

a forming unit configured to form a detection image made of a developing material on said image carrier;

an irradiation unit configured to irradiate said image carrier having the formed detection image with light, said irradiation unit being capable of switching a size of a light-emitting region to emit the light to irradiate;

a light-receiving unit configured to receive reflected light of the light irradiated by said irradiation unit and output a detection signal corresponding to a light-receiving amount of the reflected light including a specular-reflected light component;

a detection unit configured to detect one of position information and density information of the detection image based on a signal corresponding to a difference between a value of the detection signal corresponding to the light-receiving amount of the reflected light from a first position where the detection image is formed and the value of the detection signal corresponding to the light-receiving amount of the reflected light from a second position different from the first position during a time when the detection image formed on said image carrier passes through an irradiation region of said irradiation unit; and a control unit configured to control to switch the size of the light-emitting region of said irradiation unit to detect one of the position information and the density information of the detection image.

3. The apparatus according to claim 2, wherein said irradiation unit comprises:

a plurality of light-emitting elements having different light-emitting regions; and a selection unit configured to select, from said plurality of light-emitting elements, the light-emitting element to irradiate said image carrier with the light.

4. The apparatus according to claim 2, wherein the detection image includes a plurality of lines in a direction different from a moving direction of the detection image, and said forming unit is further configured to change one of a width of the plurality of lines and a pitch of the lines in accordance with a detection accuracy necessary for detection control.

5. The apparatus according to claim 2, wherein said control unit is further configured to perform control based on one of a signal-to-noise ratio of the detection signal and a speed of rise of the detection signal.

6. The apparatus according to claim 2, wherein said irradiation unit is further configured to irradiate said image carrier with a divergent beam.

7. The apparatus according to claim 2, wherein a position of an image to be formed is corrected using the position information, or a density of the image to be formed is corrected using the density information.

8. An image forming apparatus comprising:

an image carrier;

a forming unit configured to form a detection image made of a developing material on said image carrier;

an irradiation unit configured to irradiate said image carrier having the formed detection image with light, said irradiation unit being capable of switching a size of a light-emitting region to emit the light to irradiate;

a light-receiving unit configured to receive reflected light of the light irradiated by said irradiation unit and output a detection signal corresponding to a light-receiving amount of the reflected light including a specular-reflected light component;

a detection unit configured to detect one of position information and density information of the detection image based on a signal corresponding to a difference between a sum of values of the detection signals corresponding to at least one first time position and a sum of values of the detection signals corresponding to at least one second time position apart from the first time position by a predetermined period, which are detected during a time when the detection image formed on said image carrier passes through an irradiation region of said irradiation unit; and a control unit configured to control to switch the size of the light-emitting region of said irradiation unit to detect one of the position information and the density information of the detection image.

9. The apparatus according to claim 8, wherein said control unit is further configure to perform control based on one of a signal-to-noise ratio of the detection signal and a speed of rise of the detection signal.

10. The apparatus according claim 8, wherein the value of the detection signal corresponding to the first time position is an average value in a first section of the detection signal, and the value of the detection signal corresponding to the second time position is an average value in a second section apart from the first section by the predetermined period.

11. A detection apparatus comprising:

an irradiation unit configured to irradiate an image carrier on which a detection image made of a developing material is formed with light, said irradiation unit being capable of switching a size of a light-emitting region to emit the light to irradiate;

a light-receiving unit configured to receive reflected light of the light irradiated by said irradiation unit and output a detection signal corresponding to a light-receiving amount of the reflected light including a specular-reflected light component;

a detection unit configured to detect one of position information and density information of the detection image based on a signal corresponding to a difference between a sum of values of the detection signals corresponding to at least one first time position and a sum of values of the detection signals corresponding to at least one second time position apart from the first time position by a predetermined period, which are detected during a time when the detection image formed on said image carrier passes through an irradiation region of said irradiation unit; and a control unit configured to control to switch the size of the light-emitting region of said irradiation unit to detect one of the position information and the density information of the detection image.

12. An image forming apparatus comprising:

an image carrier;

a forming unit configured to form a detection image made of a developing material on said image carrier;

an irradiation unit configured to irradiate said image carrier having the formed detection image with light, said irradiation unit being capable of switching a size of a light-emitting region to emit the light to irradiate;

at least one first light-receiving unit configured to receive reflected light of the light irradiated by said irradiation unit and output a first detection signal corresponding to a light-receiving amount of the reflected light including a specular-reflected light component;

at least one second light-receiving unit configured to receive the reflected light of the light irradiated by said irradiation unit and output a second detection signal corresponding to the light-receiving amount of the reflected light including the specular-reflected light component;

a detection unit configured to detect one of position information and density information of the detection image based on a signal corresponding to a difference between a sum of values of the first detection signals output from said first light-receiving unit and a sum of values of the second detection signals output from said second light-receiving unit during a time when the detection image formed on said image carrier passes through an irradiation region of said irradiation unit; and a control unit configured to control to switch the size of the light-emitting region of said irradiation unit to detect one of the position information and the density information of the detection image.

13. The apparatus according to claim 12, wherein said control unit is further configured to perform control based on one of a signal-to-noise ratio of each of the first detection signals and the second detection signals and a speed of rise of each of the first detection signals and the second detection signals.

14. A detection apparatus comprising:

an irradiation unit configured to irradiate an image carrier on which a detection image made of a developing material is formed with light, said irradiation unit being capable of switching a size of a light-emitting region to emit the light to irradiate;

at least one first light-receiving unit configured to receive reflected light of the light irradiated by said irradiation unit and output a first detection signal corresponding to a light-receiving amount of the reflected light including a specular-reflected light component;

at least one second light-receiving unit configured to receive the reflected light of the light irradiated by said irradiation unit and output a second detection signal corresponding to the light-receiving amount of the reflected light including the specular-reflected light component;

a detection unit configured to detect one of position information and density information of the detection image based on a signal corresponding to a difference between a sum of values of the first detection signals output from said first light-receiving unit and a sum of values of the second detection signals output from said second light-receiving unit during a time when the detection image formed on said image carrier passes through an irradiation region of said irradiation unit; and a control unit configured to control to switch the size of the light-emitting region of said irradiation unit to detect one of the position information and the density information of the detection image.

* * * * *